United States Patent [19]

Close

[11] 3,979,051

[45] Sept. 7, 1976

[54] MULTI-COMPARTMENT ENVELOPE

[75] Inventor: Patrick J. Close, Media, Pa.

[73] Assignee: American Fiber Velope Manufacturing Company, Collingdale, Pa.

[22] Filed: June 23, 1975

[21] Appl. No.: 589,343

[52] U.S. Cl. ..... 229/72; 150/39; 206/455; 229/56

[51] Int. Cl.[2] ..... B65D 27/08; B65D 85/30

[58] Field of Search ..... 229/71, 72, 56, 70; 206/316, 312, 313, 311, 455; 150/39

[56] References Cited

UNITED STATES PATENTS

| | | | |
|---|---|---|---|
| 1,646,426 | 10/1927 | Snape | 229/72 |
| 3,337,119 | 8/1967 | Bowers et al. | 206/312 |
| 3,370,405 | 2/1968 | Fesco | 229/56 |
| 3,399,824 | 9/1968 | Dodge | 229/72 |
| 3,420,432 | 1/1969 | Cooper | 229/72 |
| 3,512,702 | 5/1970 | Pritchard, Jr. | 229/71 |
| 3,856,198 | 12/1974 | Daley | 229/72 |

*Primary Examiner*—Stephen P. Garbe
*Assistant Examiner*—Bruce H. Bernstein
*Attorney, Agent, or Firm*—Stanley Bilker

[57] ABSTRACT

A multi-compartment envelope which is resistant to tearing includes a first sheet folded along a medial line to define a front and back panel and a second sheet whose margins are adhesively secured to the interior surface of the front panel. A slot in the front panel permits access to the pocket formed by said front panel and the second sheet adhered thereto while a second pocket is formed in the envelope by adhesively securing lateral flaps on the back panel to the front surface of the front panel thereby providing a reinforced construction.

7 Claims, 4 Drawing Figures

FIG. 1
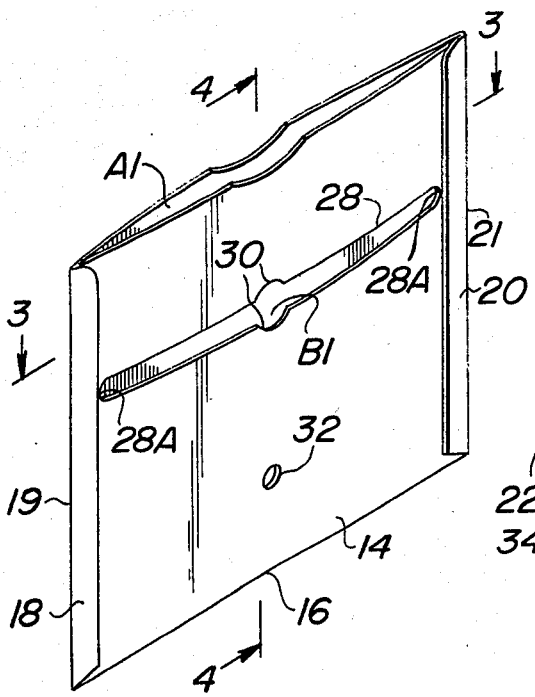
FIG. 2
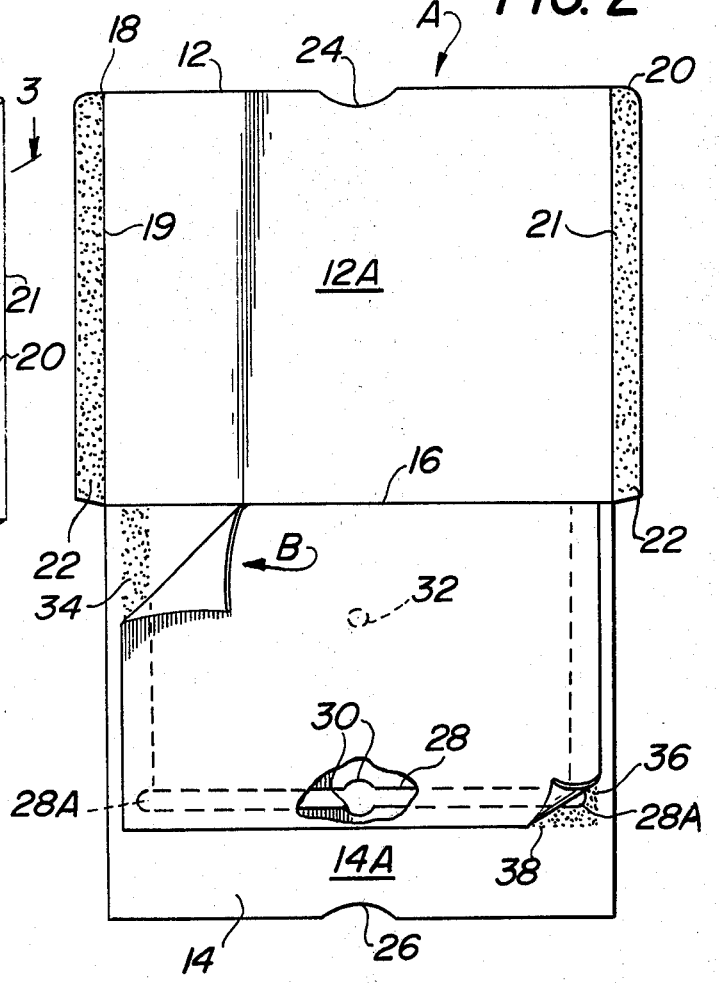
FIG. 3
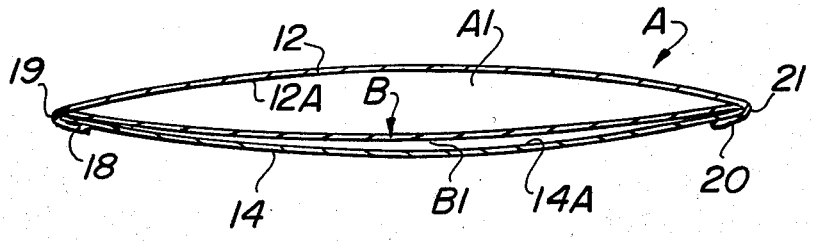
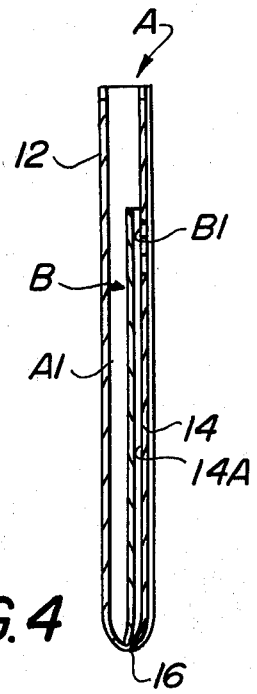
FIG. 4

MULTI-COMPARTMENT ENVELOPE

This invention relates to multi-compartment envelopes, and more particularly relates to a dual compartment envelope which is especially adapted to hold or store X-ray film in one pocket while permitting other papers, memoranda and patient's records and information in a second pocket.

In the past, dual compartment envelopes were fabricated by cementing three marginal edges of a rectangular sheet to the exterior face of the envelope's front panel to form a pocket in which papers could be contained separate from the materials in the envelope proper. However, since the cemented or glued edges of the rectangular sheet were constantly exposed to stresses and strains during insertion or removal of the contents from the front pocket, repeated failures occurred as a result of tearing of the pockets along the glue lines.

It is therefore an object of this invention to provide a multi-compartment envelope in which there is maximum resistance to tearing of any of the pockets.

Another object of this invention is to provide a high strength multi-compartment envelope which can readily be made by hand or on high speed envelope fabrication machinery.

Still another object of this invention is to provide a multi-compartment envelope which the glued seams of the front pocket are concealed and reinforced by the configuration of the envelope per se.

Yet still another object of this invention is to provide a high strength dual compartment envelope which can accommodate printed, written or typed indicia.

Other objects of this invention are to provide an improved device of the character described which is easily and economically produced, sturdy in construction, and both highly efficient and effective in operation.

With the above and related objects in view, this invention consists of the details of construction and combination of parts as will be more fully understood from the following detailed description when read in conjunction with the accopanying drawing in which:

FIG. 1 is a perspective view of a dual compartment envelope embodying this invention.

FIG. 2 is a plan view of the multi-compartment envelope showing the form of the blank during the first stages of fabrication.

FIG. 3 is a sectional view taken along lines 3—3 of FIG. 1.

FIG. 4 is a sectional view taken along lines 4—4 of FIG. 1.

Referring now in greater detail to the drawing in which similar reference characters refer to similar parts, there is shown a multi-compartment envelope of the present invention, the illustration being of a dual pocketed envelope comprised of a first sheet or blank, generally designated as A, which acts as a primary pocket A1 when the blank is formed, and a second sheet, generally designated as B, which is secured in adhered disposition to the interior surface of the first sheet when the blank is folded to define a secondary pocket B1.

The blank A is of paper, cardboard, plastic or other suitable material and includes a back panel 12 with a front panel 14 hingedly secured thereto along a transverse fold line 16. A pair of flaps 18 and 20 outwardly project from the lateral edges of the back panel 12 along fold lines 19 and 21 respectively. Adhesive 22 is applied to the upwardly extending surfaces of the flaps 18 and 20, as shown in FIG. 2, such upwardly extending surfaces corresponding to the interior face of the back panel 12 and being designated 12A. An arcuate cut-out 24 is provided along the free edge of the back panel, such cut-out registering with a similar cut-out 26 in the front panel 14 when the front panel is folded into overlying disposition with the back panel. This relief yielded by the cut-outs facilitates access to the contents in the primary pocket A1.

The front panel 14 is in general dimensionally coextensive with the back panel 12 and includes an elongated slot 28 which is stamped therein when the blank is formed. The slot 28 extends across almost the entire face of the front panel and incorporates rounded edges 28A at the ends thereof to effect maximum resistance to tearing. The center portion of the slot 28 has semicircular reliefs 30 to facilitate access to the contents of the pocket B1. An aperture 32 is also cut in the front panel 14 whereby smaller papers contained in the pocket B1 will be visible.

The sheet B may be of the same material as the blank A although thinner and less expensive stock may be employed in view of the fact that sheet B merely acts as a partition wall. While it is preferable that sheet B be as large as possible to define a relatively large front pocket, the dimensions of sheet B need not be identical to those of the front panel. To form the pocket B1, sheet B is laid upon the upwardly facing surface 14A of the front panel with one edge of sheet B in registration with the fold line 16, as shown in FIG. 2. Sheet B is then glued to what will become the interior surface of the front panel along cement stripes 34 and 36 at the lateral margins and transverse stripe 38 outside the slot 28. An additional cement seam (not shown) may be applied to surface 14A adjacent the fold line 16, but this seam is optional.

After the sheet B is adhesively secured to the front panel surface 14A to define the pocket B1, the sheet A is folded in half along the score line 16 such that the front and back panels are in registration, flaps 18 and 20 are folded along their respective hinge lines 19 and 21 and adhesively secured to the outside marginal surface of the front panel 14, as shown in FIGS. 1 and 3. It is also feasible to incorporate the flaps 18 and 20 at the lateral edges of the front panel, in which case, such flaps would be folded down upon the outside surface of the back panel 12.

As is readily apparent from FIGS. 3 and 4, none of the cemented margins 34, 36 or 38 are exposed to tearing action when papers are inserted into or removed from the pocket B1. That is, the sealed edges of the pocket B1 are concealed behind the front panel and are reinforced by the flattening action of the back panel in abutment therewith. As a consequence, a far stronger dual compartment envelope is provided in comparison to an envelope in which the pocket B1 would be formed by simply gluing a sheet B to the outside or front face of an outer panel. As is also apparent, a second outside pocket can also be formed on the inside surface of the back panel, and suitable indicia may be imprinted upon the outside surfaces of the front or back panel before or after fabrication of the envelope.

Although this invention has been described in considerable detail, such desciption is intended as being illustrative rather than limiting, since the invention may be variously embodied without departing from the spirit or scope thereof, and the metes and bounds of the invention is to be determined as claimed.

What is claimed is:

1. A multi-compartment envelope comprising:

a. a first sheet folded along a medial line thereof defining a front and back panel, said front and back panel secured together on opposing lateral edges forming a first vertically accessible pocket opening;

b. a second sheet separate and distinct from said first sheet and having dimensions not exceeding those of said front panel; and, c. means cementing at least an upper portion of the marginal edges of the second sheet to the interior surface of said front panel, said front panel having a slot formed therethrough being vertically displaced from said first pocket opening, said upper portion marginal edges of said second sheet being cemented to said interior surface above and contiguous to said slot to enable vertical access to a second pocket opening between the front panel and the second sheet.

2. The envelope of claim 1 including reinforcing means defining flaps hinged along axes substantially aligned with the lateral edges of one of said panels.

3. The envelope of claim 1 wherein said slot includes arcuate edges at the ends thereof.

4. The envelope of claim 3 wherein semi-circular cut-outs are formed at the central portion of the slot.

5. The envelope of claim 1 including a viewing aperture in the front panel.

6. The envelope of claim 2 wherein the front and back panels are of substantially the same size, and said flaps are coextensive with the lateral edges of one of said panels.

7. The envelope of claim 2 wherein said flaps are hinged to the back panel and adhered to the front panel.

* * * * *